US005419448A

United States Patent [19]

Watson

[11] Patent Number: 5,419,448

[45] Date of Patent: May 30, 1995

[54] KNOCK DOWN BULK STORAGE CONTAINER

[76] Inventor: John Watson, 87 Yorkview Dr., Toronto, Ontario, Canada

[21] Appl. No.: 5,402

[22] Filed: Jan. 19, 1993

[51] Int. Cl.[6] ..... B65D 6/22

[52] U.S. Cl. ..... 220/4.28; 220/4.31; 220/6; 220/403; 222/185

[58] Field of Search ..... 220/7, 6, 4.31, 4.28, 220/1.5, 4.29, 4.32, 400, 403, 404, 461, 460, 532, 533; 217/12 R, 13, 15, 45, 47; 222/185, 181; 206/600

[56] References Cited

U.S. PATENT DOCUMENTS

| | | | |
|---|---|---|---|
| 1,439,450 | 12/1922 | Scott | 220/4.31 |
| 1,803,385 | 5/1931 | Finnegan . | |
| 2,952,379 | 9/1960 | Potter . | |
| 3,185,516 | 5/1965 | Johansson | 222/181 |
| 3,414,156 | 12/1968 | Fredrik-Felldin . | |
| 3,782,602 | 1/1974 | Page | 222/185 |
| 3,853,238 | 12/1974 | Luisada et al. | 220/4.28 |
| 3,989,156 | 11/1976 | Lowry . | |
| 4,673,087 | 6/1987 | Webb | 206/600 |
| 4,809,851 | 3/1989 | Oestreich, Jr. et al. . | |
| 5,110,000 | 5/1992 | Nichols | 220/403 |
| 5,161,709 | 11/1992 | Oestreich, Jr. | 220/1.5 |
| 5,163,587 | 11/1992 | Apps et al. | 222/185 |

FOREIGN PATENT DOCUMENTS

| | | |
|---|---|---|
| 611899 | 10/1960 | Italy . |
| 808492 | 2/1959 | United Kingdom . |

*Primary Examiner*—Stephen J. Castellano

[57] ABSTRACT

A knock down bulk storage container is designed to receive a liquid impervious storage bag. The container comprises a bottom wall, a first pair of opposing side walls and a second pair of opposing side walls. One pair of side walls has T-shaped undercut outer ends, and the other pair of side walls has T-shaped outer ends for slidably fitting in and out of the undercut outer ends on the one pair of side walls to assemble and dismantle the container. When the container is dismantled, the first pair of walls are stored in a horizontal position vertically stacked relatively to one another on the bottom wall and then the second pair of side walls are folded inwardly down over the first pair of walls and the bottom wall. The container is provided along its front lower edge with a cut out extending through the container for fitting a dispenser to the bag when it is placed in the container.

1 Claim, 4 Drawing Sheets

KNOCK DOWN BULK STORAGE CONTAINER

FIELD OF THE INVENTION

The present invention relates to a knock down bulk storage container specifically designed to receive and allow dispensing from a bulk liquid storage bag.

BACKGROUND OF THE INVENTION

There is a need in the market place for an extremely durable heavy duty storage system comprising a container and a liquid impervious storage bag. Furthermore, the container must have knock down features so that it can be dismantled when not in use. However, a typical knock down container does not have sufficient strength, particularly at the releasable connection points of the container for storing overly heavy products.

A container capable of receiving a bulk storage bag must necessarily be reinforced but should be free of strengthening ribs etc. on the interior surface of the container on which the bag might otherwise catch and rip. As a further feature, the container should include means for accessing liquid when the bag is in the container.

At the present time, there does not appear to be anything available on the market place in the way of a bulk storage container with the features listed above.

SUMMARY OF THE INVENTION

The present invention provides a knock down bulk storage container specifically designed to receive a bulk liquid bag. More particularly, the knock down container of the present invention comprises a bottom wall, a first pair of opposing side walls and a second pair of opposing side walls. One pair of side walls includes T-shaped undercut outer ends and the other pair of side walls has T-shaped outer ends for slidably fitting in and out of the undercut ends on the one pair of side walls to assemble and dismantle the container. The container further includes a cut out along the front lower edge of the container for fitting a dispenser to the bulk liquid bag when it is placed in the container.

When the container is dismantled, the first pair of side walls is storable in a horizontal position vertically stacked relatively to one another on the bottom wall and the second pair of side walls is foldable inwardly down over the pair of side walls stacked on the bottom wall.

BRIEF DESCRIPTION OF THE DRAWINGS

The above, as well as other advantages and features of the present invention, will be described in greater detail according to the preferred embodiments of the present invention in which.

Figure 1:
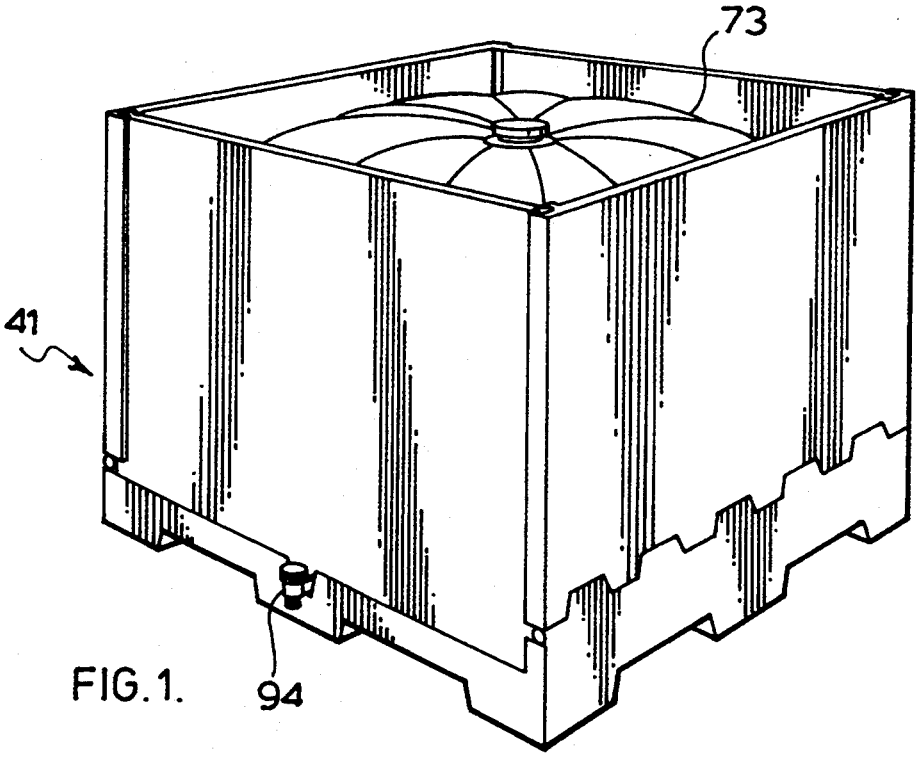
FIG. 1 is a perspective view of a bulk storage system according to a preferred embodiment of the present invention.

DETAILED DESCRIPTION ACCORDING TO THE PREFERRED EMBODIMENTS OF THE PRESENT INVENTION

A bulk storage containment system of the present invention comprises a knock down container generally indicated at 41 and a liquid impervious liquid storage bag generally indicated at 73 to be placed in the container.

The container is designed to hold extremely heavy loads even though it is of a knock down construction. Furthermore, the walls of the container have little or no outward deflection even though the container is preferably made from a plastic material and the bag in the container when completely filled may weight up to and in excess of 3,000 lbs. One of the keys to the construction is the shape of the releasable interlock at the four corners of the container to be described later in detail.

The container itself comprises a pallet like base 43, having a series of fork lift recesses which allow lifting of the container from below its base.

Supported by the container base are a plurality of upright walls including a first set of walls 45 and 51 and a second set of walls 57 and 59. In the particular arrangement shown, wall 57 is the front wall of the container. Accordingly, facing 63 is located at the lower front of the container. Spaced behind facing 63 is a small wall 65 with a narrow space 61 being provided between the facing and the small wall.

Wall 65 includes a rectangular cut out or recess 71, while facing 63 includes a larger cut out 69 aligned with cut out 71.

Figure 3:
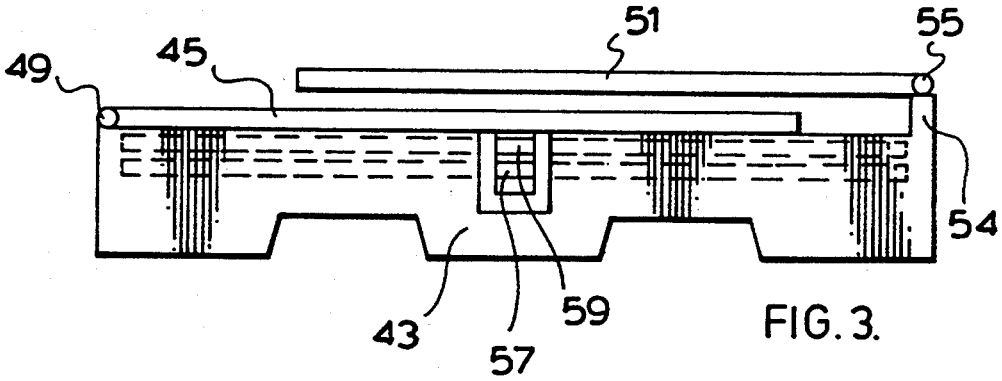
FIG. 3 is a front view of the container from FIGS. 1 and 2 with the bag removed and in a knocked down position.

Wall 45 is secured at hinge connection 49 to the base 43, while wall 51 is secured by hinge connection 55 to the base. As best seen in FIG. 3 of the drawings, hinge 55 sits atop a small vertical leg 54 so that the hinge point at the base of wall 51 is higher than the hinge point at the base of wall 45.

Figure 4:
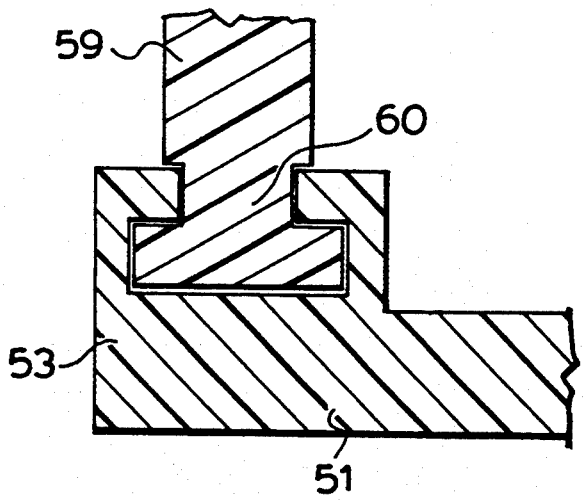
FIG. 4 is a top view of one of the comer connection regions from the container shown in FIG. 3.
Figure 2:
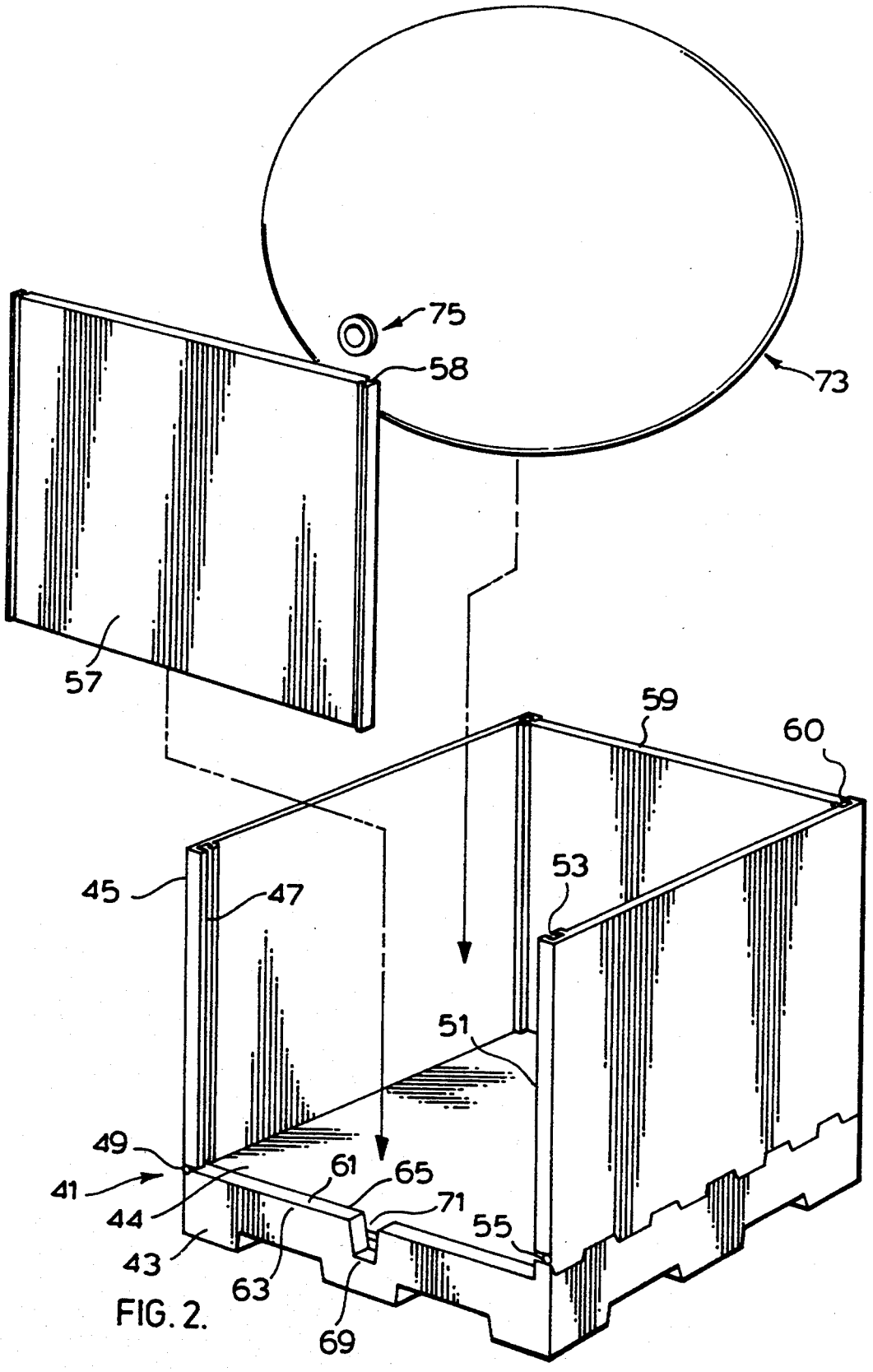
FIG. 2 is a exploded perspective view of the system shown in FIG. 1 of the drawings.

Each of the walls 45 and 51 includes a T-shaped undercut channel at the opposite outside edges of these two upright walls. Walls 57 and 59, on the other hand, include T-shaped outer ends which fit slidably into the T-shaped channels. FIG. 4 shows the outside edge region 53 of wall 51 as including a T-shaped undercut channel and also shows the T-shaping of outer end 60 on wall 59. This interlocking connection is identical at all four corners of the container.

The container can easily be dismantled from the FIG. 1 position by simply sliding the ends of walls 57 and 59 out of the channels at the ends of walls 45 and 51. From here the walls 57 and 59 are laid flat onto the bottom wall or floor 44 of the pallet base 43. As can be appreciated from FIG. 3 of the drawings, the bottom wall 44 is recessed relative to the facing on the container base to the extent that the stored walls 57 and 59 are trapped against sliding out of the container base.

Once the walls 57 and 59 have been released from their upright position and stored in the container base, wall 45 is folded down on top of these two stored walls and wall 51 is then folded down on top of wall 45 as shown in FIG. 3 of the drawings. Here it will be seen that the short upright leg 54 which raises the pivot point 55 at the base of wall 51 allows this wall to fold completely flat on top of wall 45.

The use of a T-shaped interlock, i.e. an interlock having right angular mating faces is critical at the four comers of the container because of the plastic construction of the walls which must support extremely heavy loads placed on the container. If anything other than a right angular interface is used such as, for example, a dove-tailed shaped interlock, the pressure created at the connection could cause the plastic material to creep resulting in container breakdown.

As earlier described, the upright edge of the container base includes a slot or channel 61 between the front facing 63 and the small vertical wall 65. The lower edge of the front wall 57 seats in this small channel 61 where it is trapped from bowing outwardly at the base of the container. A similar channel is provided at the other end of the base for locking the bottom edge of wall 59 from bowing outwardly from the base.

Figure 8:
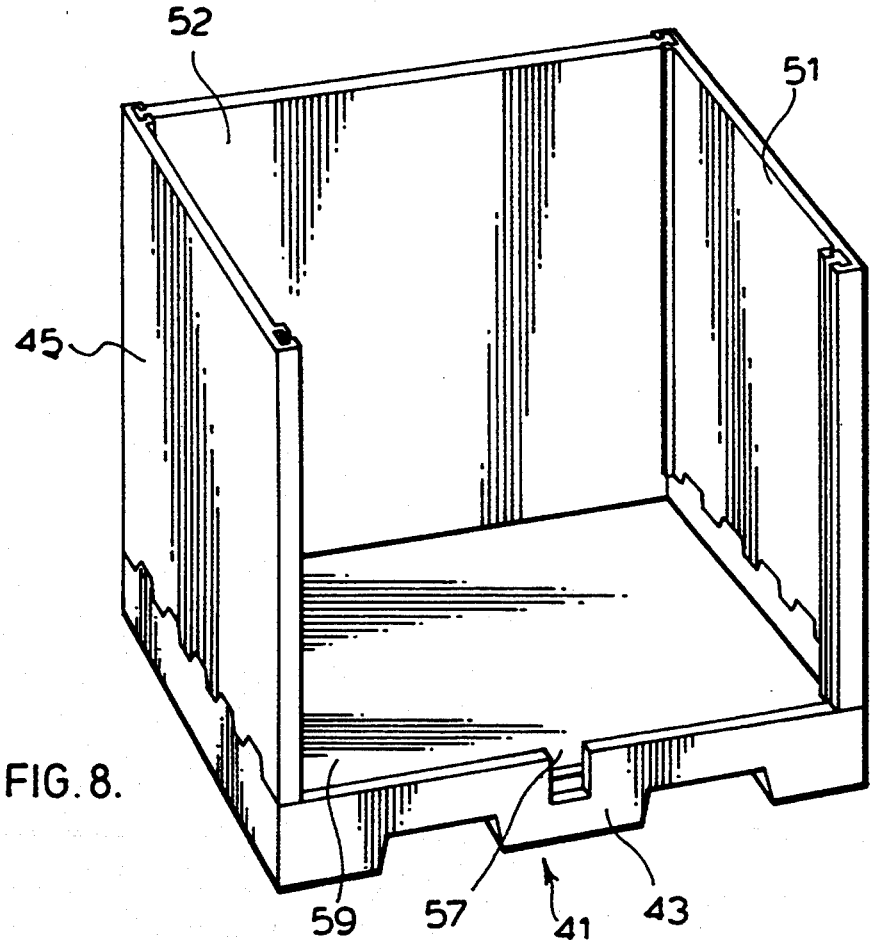
FIG. 8 is a partially assembled perspective view of the container of FIG. 1 showing a specific assembly step of the container.

In order to assemble the container, the walls 45 and 51 are moved back up to their upright position as shown in FIG. 8 of the drawings. This allows retrieval of the two walls 57 and 59 to be slid back down into the outside edge channels on the walls 45 and 51. FIG. 8 further shows an additional assembly piece 52 which does not actually form part of the overall container but which eases assembly of the container. In particular, the piece 52 is relatively light in weight and is only used to initially hold the sides 45 and 51 in a upright position by sliding the assembly piece down into the slide channels on the upright walls as shown in FIG. 8 of the drawings. The container will now hold this configuration freeing up both hands of the person assembling the container to retrieve the additional side walls 57 and 59. One of these two side walls is then fitted into the unsecured end of the container at which point assembly piece 52 is removed and the other stored sidewall is then fitted into the channels which have now been cleared by removing piece 52. Accordingly, assembly piece 52 allows a one man assembly of the overall container.

FIG. 1 of the drawings shows the container when assembled and fitted with bulk liquid bag 73. If desired, a top can be fitted over this overall assembly to complete the container construction. Note that the interior of the sidewalls are all flat and free of anything that might otherwise catch on the bag.

Figure 5:
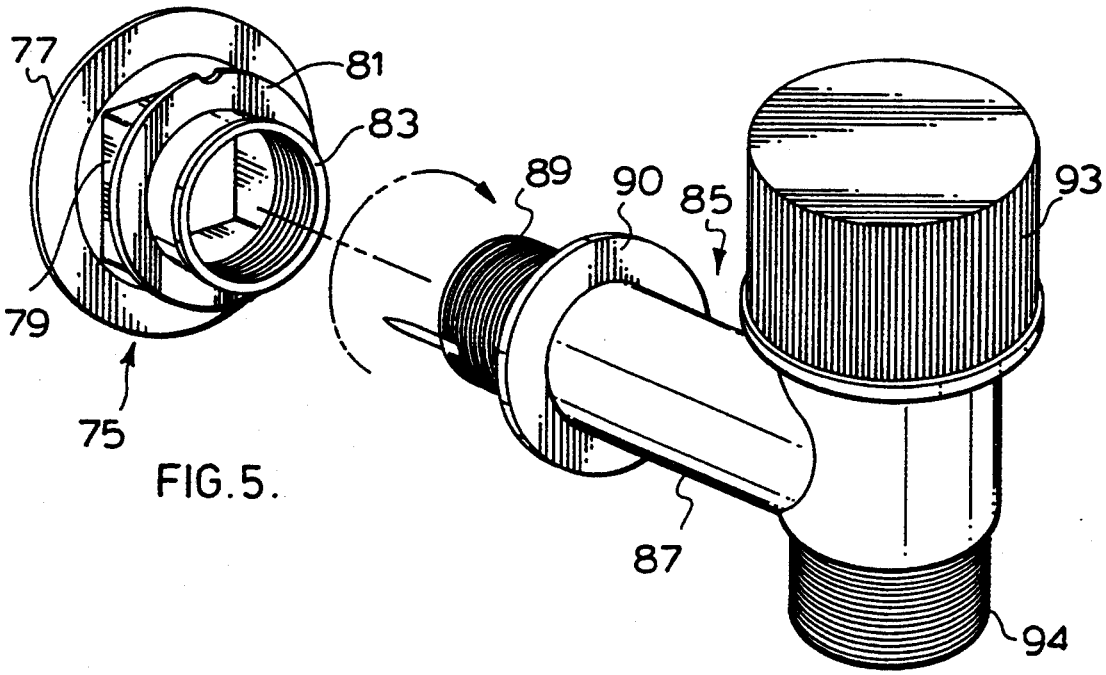
FIG. 5 is a perspective view of a dispenser to be fitted to the bag in the system shown in FIG. 2.
Figure 6:
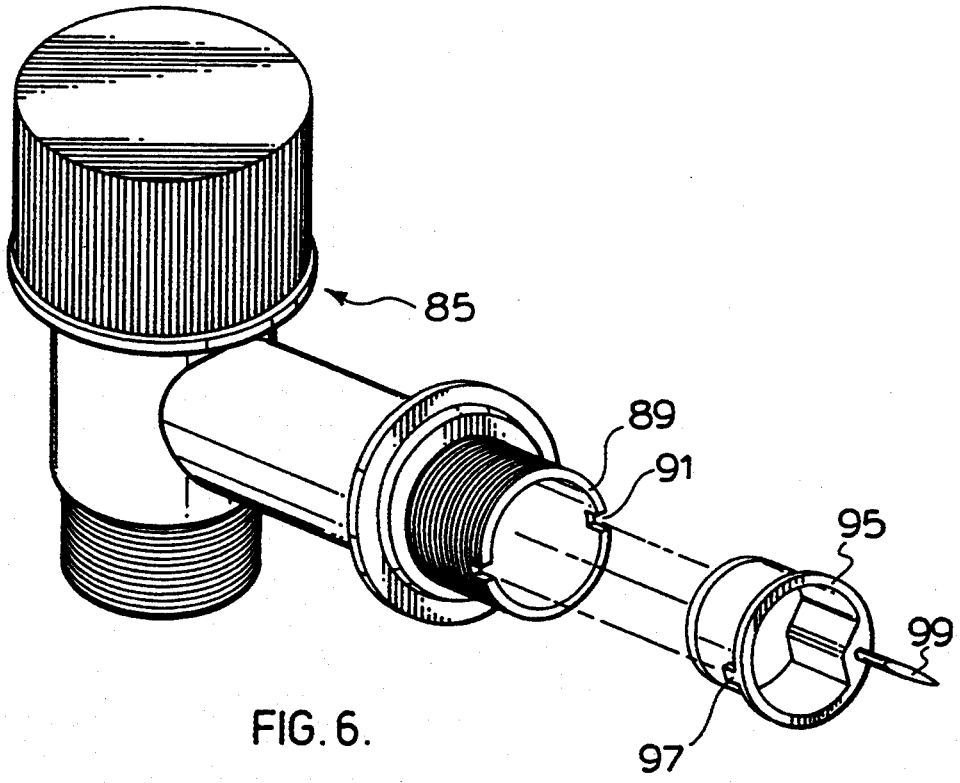
FIG. 6 is a further perspective view of the dispenser shown in FIG. 5.

In accordance with the present invention, bag 73 is not only stored within container 41 but, in addition, the contents of the bag can be dispensed with the bag held in the container. FIGS. 5 and 6 of the drawings show a preferred embodiment dispensing valve usable with the overall system as shown in FIG. 1 of the drawings.

The dispensing valve construction includes a spout generally indicated at 75 in FIG. 5 of the drawings. Spout 75 includes a rear mounting flange 77 which secures directly to bag 73. The securing of the spout to the bag can be achieved, for example, by heat sealing or the like without penetrating the body of the bag.

Located forwardly of the securing flange 77 is a rectangular body portion 79 with a forward lip 81 directly in front of the rectangular body portion. A threaded connector 83 extends forwardly from flange 81.

Figure 7:
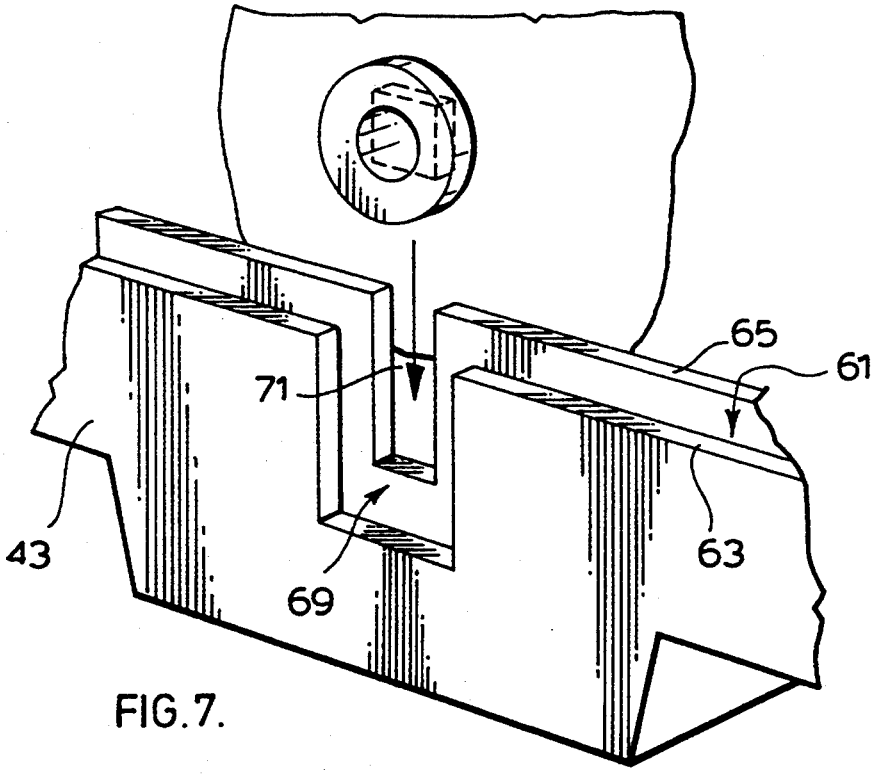
FIG. 7 is an enlarged exploded view of the lower front edge of the container of FIGS. 1 and 2 and specifically showing fitting of the dispenser from the bag to the container.

The spout 75 is secured to bag 73 before loading it into the container, however, the bag remains intact because the spout itself does not penetrate the bag. In order to properly locate the bag in the container, the rectangular body pan 79 drops down into rectangular recess 71 in the back wall 65 of the upright facing on the container base as shown in FIG. 7 of the drawings. Note that recess 71 is cut deeper than the channel 61 between the facing walls 63 and 65. This allows the spout to be fitted into the container base without interfering with the bottom edge of upright wall 57. The spout remains trapped in recess 71 because the two flange portions 77 and 81 are trapped on opposite sides of facing wall 65. Furthermore, the rectangular configuration of body part 79 fitted into the corresponding rectangular recess 71 prevents twisting or torquing of the spout relative to the base.

The overall dispensing assembly further includes a dispenser control 85 well shown in FIGS. 5 and 6 of the drawings. This control includes an elongated hollow neck 87 terminating at its outer end with a dispensing opening 94 and a valve control 93 which is rotated to open and close opening 94. The inner end of neck 87 comprises a threaded connector 89 terminating at flange 90. The threaded connector 89 is, as shown in FIG. 6, provided with a pair of small slots 91. A cutter adapter 95, which is designed to fit in the threaded connector 89, includes bosses 97 which lock into the slots 91 and rotationally couple the cutter adapter with the threaded connector. Cutter adapter 95 further includes a cutting pin 99.

As earlier described, the sealed bag is stored in the container with the spout secured to the bag. In order to penetrate the bag for dispensing purposes, dispenser 87 with the cutter adapter secured to the dispenser is threaded into the spout with pin 99 penetrating the bag and cutting out an opening from the bag through the spout as the dispenser is threaded onto the spout. The dispenser is threaded into position until flange or gasket 90 firmly abuts the outer end of the spout. Note that cut out 69 in the forward facing 63 of the base of the container allows fitting of the spout to the container and bag assembly as well shown in FIG. 1 of the drawings. The valve control 93 is then opened or closed to control flow of product through the valve opening 94.

Although various preferred embodiments of the present invention have been described herein in detail, it will be appreciated by those skilled in the art, that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A liquid containment system comprising a knock down bulk storage container having a plastic construction comprising a base with a bottom wall, front and back upright facings on said base, each of said front and back facings comprising an inner and an outer facing wall separated by a channel, a first and a second side wall, said first side wall having a lower end pivotally connected to said base, and said second side wall having a lower end pivotally connected to an upward extension of said base whereby said lower end of said second side wall is elevated relative to said lower end of said first side wall, said construction further including a front wall and a back wall having lower ends which drop down into the channels between the inner and outer faring walls at said front and back facings of said base, said front and back walls being releasably secured to said side walls at corner connections of said container, said corner connections comprising a T-shaped end on one of said walls which is fitted into a T-shaped groove in another one of said walls at each comer connection, and a liquid containing bag which is sealed prior to fitting into said container and which is held in said container, said sealed bag having a spout and said inner and said outer facing walls of said forward facing of said base having recesses into which said spout is fitted, said recesses being deeper than the channel between said inner and outer facing walls of said forward facing so that said spout does not interfere with the lower end of said front Wall of said container.

* * * * *